United States Patent [19]

Schmitt

[11] Patent Number: 4,816,807

[45] Date of Patent: Mar. 28, 1989

[54] EMERGENCY GATE RELEASE WITH ALARM

[76] Inventor: Thomas W. Schmitt, 7002 Auburn Ave., Wauwatosa, Wis. 53213

[21] Appl. No.: 157,810

[22] Filed: Feb. 19, 1988

[51] Int. Cl.[4] ..... G08B 13/06

[52] U.S. Cl. ..... 340/542; 49/141

[58] Field of Search ..... 340/542; 160/135, 215, 160/351, 162, 136, 138; 52/455; 49/49, 141, 73, 380

[56] References Cited

U.S. PATENT DOCUMENTS

| | | | |
|---|---|---|---|
| 3,312,272 | 4/1967 | Catalano | 160/162 |
| 4,638,596 | 1/1987 | Gallardo | 49/141 X |

OTHER PUBLICATIONS

Advertising leaflet entitled "Theftgard-Model 17" published by Alarm Lock Corporation, 1 page.

Advertising leaflet entitled "Safegard-Model 70" published by Alarm Lock Corporation, 1 page.

Advertising leaflet entitled "Sentrygard-Model 11" published by Alarm Lock Corporation 2 pages.

Advertising leaflet entitled "Exit Control Lock No. ECL 230K" published by Detex, 1 page.

Advertising leaflet entitled "Exit Alarm No. EA 504AC" published by Detex, 2 pages.

*Primary Examiner*—Jerry W. Myracle

*Attorney, Agent, or Firm*—Andrus, Sceales, Starke & Sawall

[57] ABSTRACT

An emergency gate release for a lattice type gate having a lock on the gate for locking the gate to a static structure. The gate release includes a lock release mechanism on one side of the gate for unlocking the gate and a rotatable release knob connected to the lock release mechanism for actuating the lock release mechanism to unlock the gate without a key. The release knob is located on one side of the gate at a location remote from the lock and inaccessible from the other side of the gate.

13 Claims, 3 Drawing Sheets

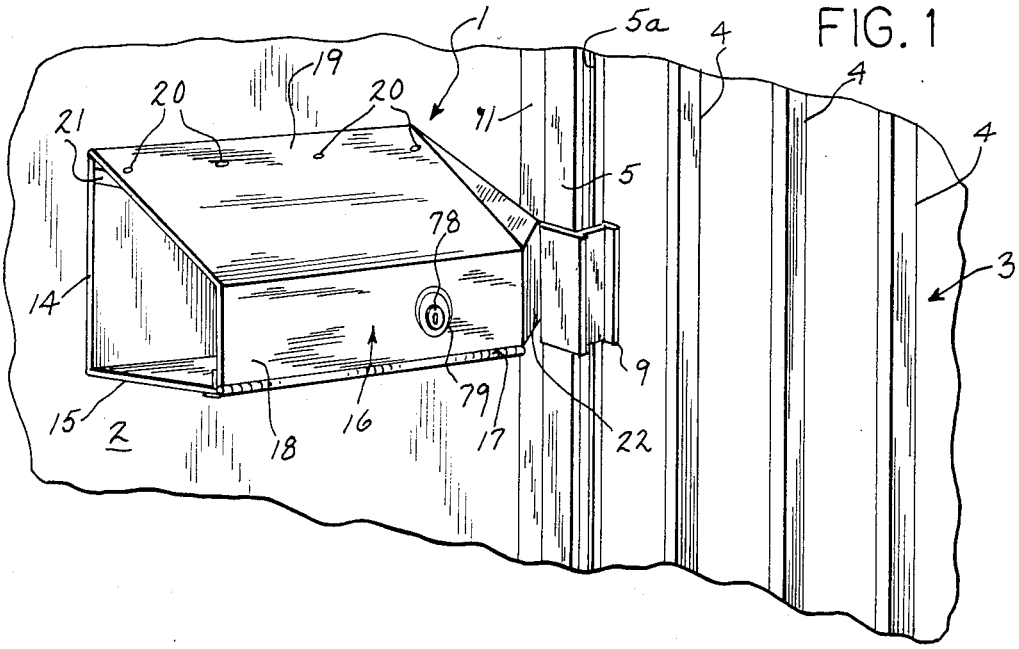
FIG. 1
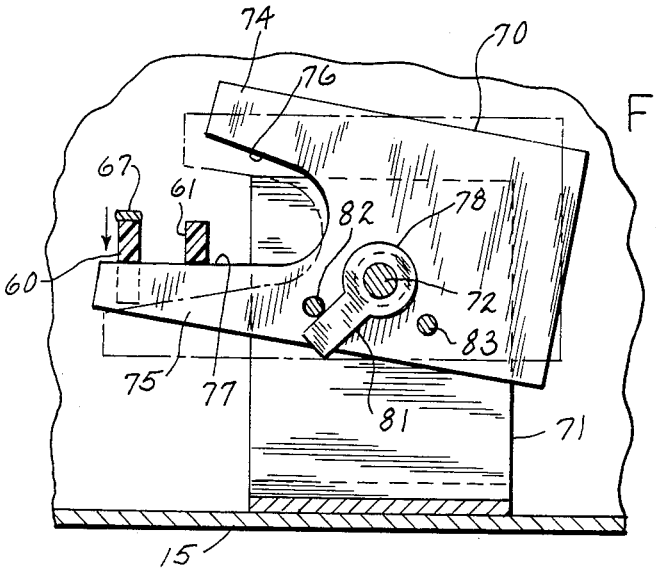
FIG. 7
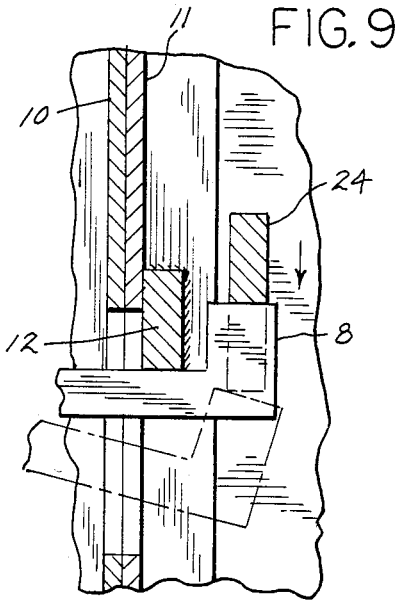
FIG. 9
FIG. 8
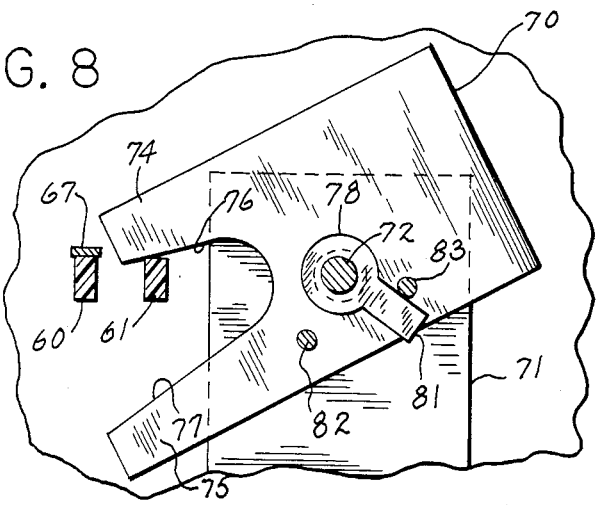
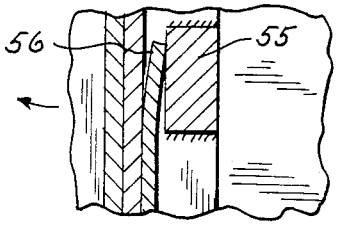

EMERGENCY GATE RELEASE WITH ALARM

BACKGROUND OF THE INVENTION

The present invention relates to security gates, and more particularly to an emergency gate release for lattice type security gates.

Security gates and doors are typically utilized in schools to control students, and to block off portions of school buildings during public events. Although installation of such gates and doors may be permitted under the provisions of state building codes, quite often, the location and/or type of gate violates the code provisions.

Typical building code provisions relating to the distribution of exits in schools and other public buildings require that all exits be distributed to provide the best possible means of egress, and generally require that exits be located so that in case any exit is blocked at any point, some other exit is accessible through public passageways at all times. Additionally, locked security gates and doors may not be placed so as to block required exit passageways or create dead end corridors.

In addition to the above code provisions, other code provisions relating to exit doors themselves require that exit doors have fastenings or hardware that permit the exit door to be opened from the inside by pushing against a single bar or gate, or by turning a single knob or handle. Further, such code provisions typically prohibit the installation of hardware requiring use of a key for opening an exit door from the inside. As a result, security exit doors typically are provided with an automatic exit device which releases the door lock by applying pressure on an emergency clapper plate or push rod which automatically releases the lock, opens the door and sounds an alarm.

Based on the requirements of such distribution of exits code provisions and such exit door code provisions, security gates and doors may not be key locked or chained at anytime in the direction of exit past the point of the security gate or door. A typical test to determine the legality of a security gate or door is, if one approaches the gate or door, from either direction, and, because of a lock situation, it is necessary to turn around and go back the way that person came, the gate or door is illegal. One must be able to continue on past the gate or door and arrive at a building exit. As a result of these requirements, lattice type security gates have fallen in disuse since such gates must be unlocked with a key when approaching from either direction. Additionally, conventional clapper plate and push rod devices are ineffective to provide security with lattice gates since a person may easily reach through the openings in the gate to unlock the gate with such devices. Therefore, it is desirable to provide a gate release device which unlocks a lattice gate when a person approaches the gate from one side thereof and at the same time be inaccessible from the other side of a lattice gate.

SUMMARY OF THE INVENTION

An emergency gate release for a lattice type gate. The lattice gate has opposite sides and a lock means on the gate for locking the gate to a static structure. The gate release device includes a lock release means on one side of the gate for unlocking the gate, and actuator means connected to the lock release means for actuating the lock release means to unlock the gate without a key wherein the actuator means is located on the one side of the gate remote from the lock means and inaccessible from the other side of the gate.

The lock means includes a keeper, a latch member pivotable between a locked position engaged with the keeper and an unlocked position disengaged from the keeper, and spring means biasing the latch member to its locked position. The lock release means includes a latch release lever pivotable between a first neutral position and a second latch release position. The latch release lever includes an inner end and an outer end wherein the outer end of the latch release lever engages the latch member and moves the latch member to its unlocked position. The actuator means includes a rotatable release knob and primary lift arm having a lever engaging end and an opposite arm engaging end. The primary lift arm is affixed to the grip member for rotation therewith at a location between its lever engaging end and its arm engaging end. The actuator means also includes a secondary lift arm having a lever engaging end and a mounting end. The mounting end of the secondary lift arm includes a pivot connection for permitting pivotable movement of the secondary lift arm. A pivot pin interconnects the arm engaging end of the primary lift arm and the secondary lift arm at a location between the lever engaging end and the mounting end of the secondary lift arm. As a result, rotation of the release knob in one direction rotates the primary lift arm in one direction so that its lever engaging end moves the latch release lever. Rotation of the release knob in the opposite direction rotates the primary lift arm in the opposite direction to pivot the secondary lift arm so that its lever engaging end moves the latch release lever.

The lock release mechanism also includes an alarm mechanism for sounding an alarm. The alarm mechanism is actuatable in response to movement of the latch release lever to its latch release position. Additionally, the alarm mechanism may be set to an on or off mode by means of a cam assembly engageable with a pair of on-off switches.

BRIEF DESCRIPTION OF THE DRAWINGS

The drawings illustrate the best mode presently contemplated of carrying out the invention.

In the drawings:

FIG. 1 is a perspective view of a lattice gate incorporating an emergency gate release in accordance with the present invention;

FIG. 7 is a fragmentary cross sectional view taken along the plane of the line 7—7 in FIG. 3 illustrating the cam mechanism for setting the alarm in its "on" mode;

FIG. 8 is a fragmentary cross sectional view similar to FIG. 7 illustrating the cam mechanism setting the alarm in its "off" mode;

FIG. 9 is an enlarged fragmentary view in cross section taken along the plane of the line 9—9 in FIG. 2 illustrating the manner of releasing the lock for the gate; and FIG. 1 is a schematic circuit diagram for the alarm system.

DESCRIPTION OF THE PREFERRED EMBODIMENT

Figure 2:
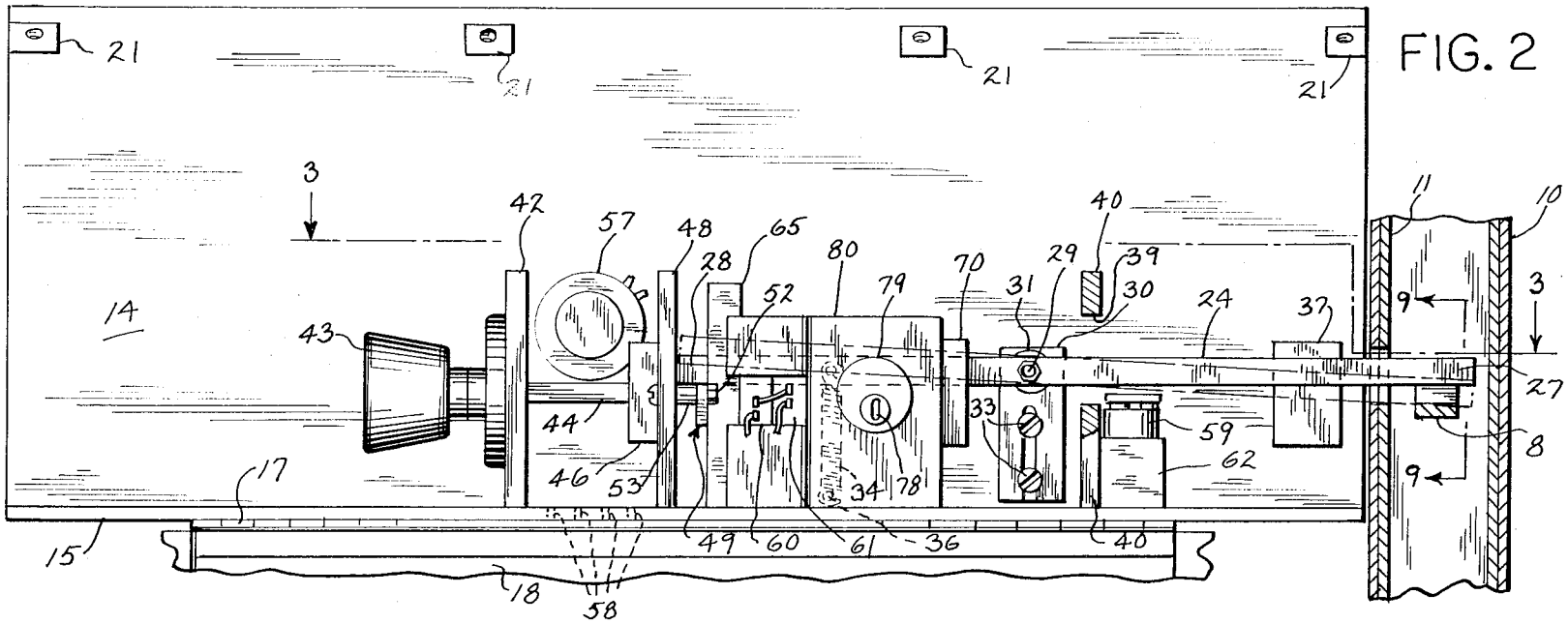
FIG. 2 is a fragmentary side view in elevation with parts broken away and in section of the gate release of FIG. 1.

Referring now to the drawings, FIG. 1 illustrates an emergency gate release generally designated by the numeral 1 mounted on a static structure such as a wall 2 for unlocking a gate 3. Gate 3 is in the form of a conventional lattice gate having a framework which includes a plurality of spaced vertically extending metal bars or strips 4. Gate 3 may be of the collapsible type wherein bars 4 are spaced as illustrated to span across and close off a hallway and are nested together adjacent one another when opened. In general, emergency gate release device 1 may be employed with any type of security gate or door which includes openings which might permit a person to reach through the door or gate from one side to unlock the gate or door from the opposite side.

Figure 3:
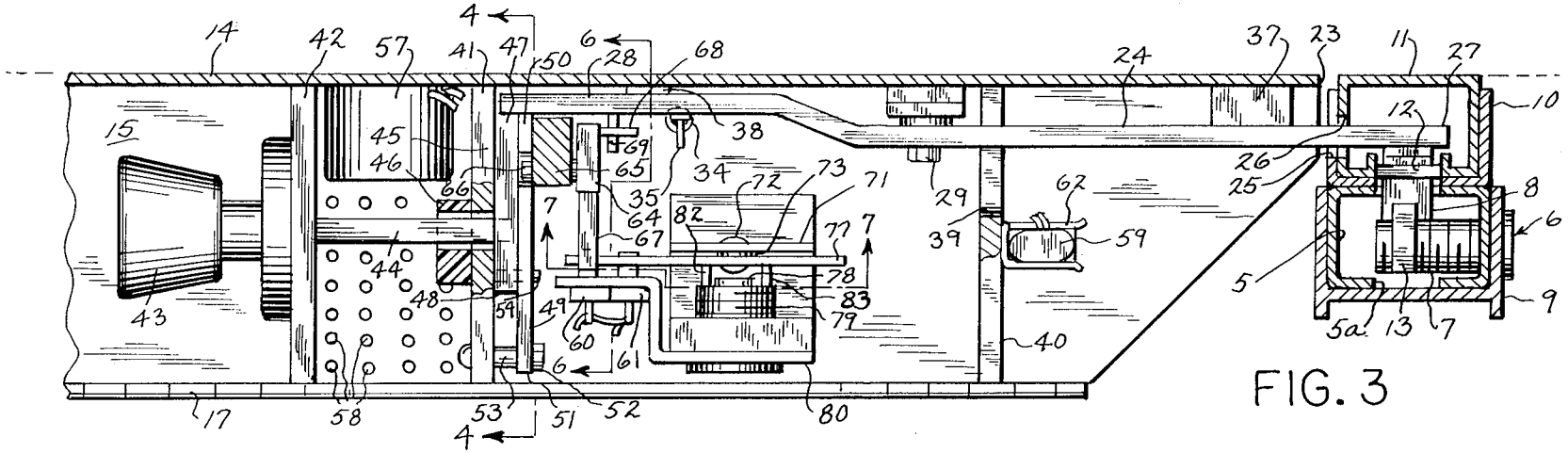
FIG. 3 is a top plan view of the gate release taken along the plane of the line 3—3 in FIG. 2.

As seen best in FIG. 3, gate 3 includes a C-shaped terminal bar 5 having an opening 5*a* formed therein extending vertically along its length. Bar 5 houses a locking mechanism 6 for gate 3 which includes a conventional key cylinder 7 and latch member 8 mounted within a C-shaped reinforcing block 9 surrounding terminal bar 5. A vertically extending C-shaped channel member 10 is connected to terminal bar 5, and as illustrated telescopes over a vertically extending support post 11 which in turn is mounted to a static structure such as wall 2. Latch member 8 is pivotable between a locked position engaged with a keeper 12 and an unlocked position disengaged from keeper 12 via the movement of a key and barrel (not shown) within cylinder 7 in a conventional manner. A spring 13 is also conventional. Thus, in order to lock gate 3 to support bar 11 gate 3 is expanded until channel member 10 telescopes over support bar 11 and latch member 8, which as shown best in FIG. 9 is an L-shaped member, automatically locks with and engages keeper 12.

Figure 4:
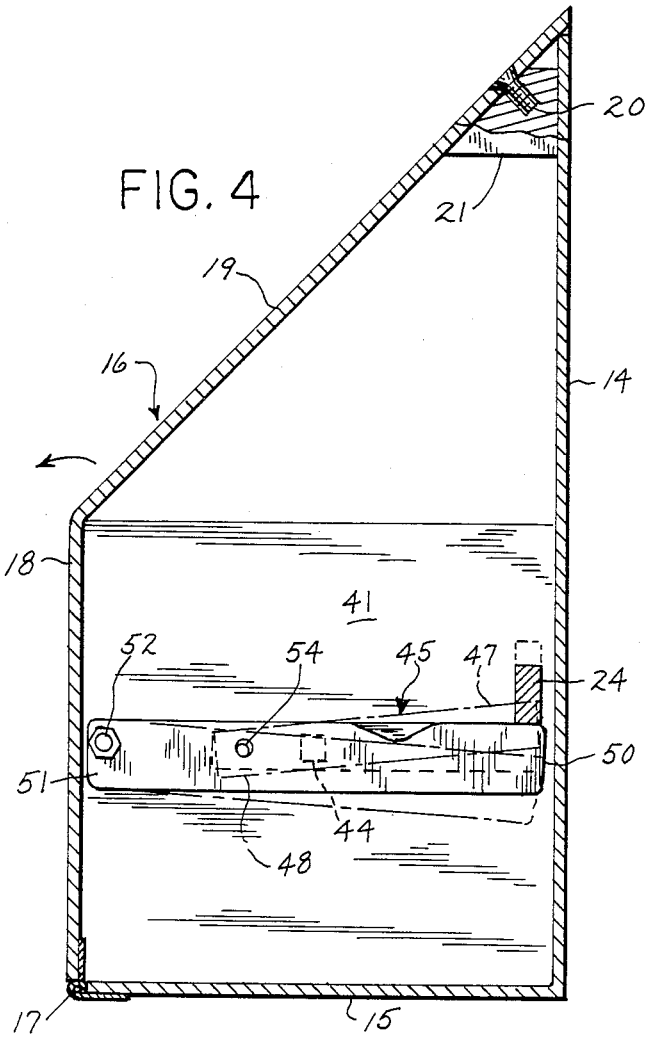
FIG. 4 is a cross sectional end view taken along the plane of the line 4—4 in FIG. 3 illustrating the actuation of the latch release lever when the release knob is rotated in one direction.

In order to release latch member 8 and unlock gate 3 from the side opposite from lock 6, there is provided emergency gate release 1. As best shown in FIGS. 1–3, gate release 1 includes a manually actuatable lock release mechanism contained within a housing mounted to wall 2. The housing includes a vertically extending rear wall 14 integrally connected to a horizontal bottom wall 15. Rear wall 14 may be attached to wall 2 by means of screws (not shown) extending therethrough into wall 2. The housing also includes a cover 16 pivotally connected to the outer edge of bottom wall 15 by means of a piano hinge 17 to prevent access to the lock release mechanism. Cover 16 includes a vertically extending front wall 18 and an inclined top wall 19 which extends between front wall 18 and rear wall 14. Top wall 19 of cover 16 is releasably connected to rear wall 14 by means of a plurality of screws 20 which extend through top wall 19 into a corresponding number of bosses 21 (see FIG. 4) projecting into the interior of the housing from rear wall 14. Screws 20 may be of the conventional security type which require a special tool such as an Allen wrench in order to permit removal thereof. Thus, the lock release mechanism contained within the housing is substantially tamper proof. As shown best in FIGS. 1 and 3, the housing is open at its rearward end remote from gate 3 so as to permit access of a user's hand, while at the same time is substantially closed at its forward end adjacent gate 3 by means of a front wall 22. Front wall 22, however, does not completely enclose the forward end of the housing (see FIG. 3) but rather defines a vertically extending slot 23 which permits a latch release lever 24 to extend therethrough and permit vertical movement thereof, as will hereinafter be described. Note that a pair of aligned openings 25, 26 in channel member 10 and support bar 11, respectively, are formed therethrough in order to permit operation of lever 24.

As noted above, the lock release mechanism contained within the housing includes latch release lever 24 which is pivotable between a first neutral position and a second latch release position. Lever 24 includes a forward end 27 and a rearward end 28 with the forward end of lever 24 operable to engage latch member 8 and move latch member 8 downwardly to its unlocked position. The pivotable connection of lever 24 is located between ends 27, 28 and is provided by a pin 29 extending therethrough into an adjusting plate 30. A bearing for lever 24 is provided by a nylon washer 31 located on pin 29 between plate 30 and lever 24. The height of pin 29 and thus the height of lever 24 may be vertically adjusted by means of moving plate 30 with respect to a mounting plate 32 on rear wall 14. In order to accomplish this, mounting plate 32 is affixed to rear wall 14 and adjusting plate 30 includes a vertically extending slot for receiving a pair of screws 33 which extend therethrough into mounting plate 32. Thus, in order to adjust the vertical height of lever 24 screws 33 are loosened until adjusting plate 30 may be moved vertically relative to mounting plate 32 whereupon screws 33 are tightened to hold pin 29 and thus lever 24 in the desired vertical position. A coil spring 34 is attached at one of its ends to a pin 35 extending from lever 24 and at its other end to a pin 36 projecting from the interior of rear wall 14. Spring 34 functions to bias lever 24 to its first neutral position. A nylon bearing block 37 projects from rear wall 14 adjacent forward end 27 of lever 24 to provide a bearing surface for sliding movement of forward end 27 of lever 24 while at the same time a nylon bearing strip 38 is mounted on rear wall 14 adjacent rearward end 28 of lever 24 to provide sliding movement for rearward end 28 of lever 24. Forward end 27 of lever 24 also projects through an opening 39 formed in a housing support wall 40 which extends between ear wall 14 and front wall 18 to support front wall 18 and top wall 19 when cover 16 is closed. Another support wall 41 adjacent rearward end 28 of lever 24 as well as a third support wall 42 spaced rearwardly from wall 41 also extend between rear wall 14 and front wall 18 and aid in supporting cover 16 when closed and mounting various components of the lock release mechanism.

Figure 5:
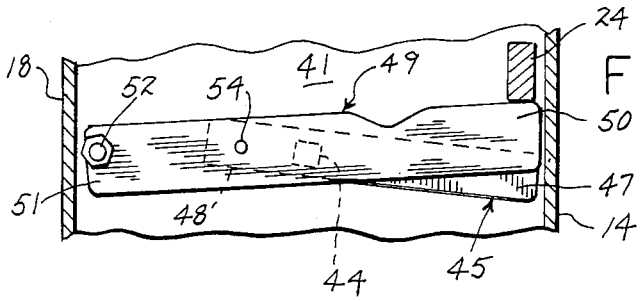
FIG. 5 is a fragmentary cross sectional view similar to FIG. 4 illustrating the actuation of the latch release lever when the release knob is rotated in the opposite direction.

As a means for actuating latch release lever 24, there is provided a rotatable release knob 43 rotatably mounted on support wall 42 together with a spindle 44 connected to knob 43 for rotation therewith. Spindle 44 extends from knob 43 through an opening in support wall 42, and at its opposite end extends through an opening in support wall 41 and is connected to a primary lift arm 45 located adjacent to wall 41. Spindle 44 extends through a nylon bearing block 46 mounted on wall 41 that provides a bearing surface for spindle 44. Primary lift arm 45 includes a lever engaging end 47 and an opposite arm engaging end 48 with its connection to spindle 44 located between ends 47, 48, as shown best in FIGS. 4 and 5. Thus, rotation of knob 43 in a clockwise direction also rotates arm 45 in a clockwise direction, and rotation of knob 43 in counterclockwise direction rotates arm 45 in a counterclockwise direction, as shown best in FIGS. 4 and 5.

The actuator mechanism also includes a secondary lift arm 49 having a lever engaging end 50 and an opposite mounting end 51. Mounting end 51 includes a pivot connection to support wall 41 which is provided by a pin 52 and a cylindrical spacer 53. Secondary lift arm 49 is also connected with arm engaging end 48 of primary lift arm 45 at a location between ends 50, 51 by means of a pivot pin 54. As a result, and as shown best in FIGS. 4 and 5, rotation of knob 43 in one direction rotates primary lift arm 45 in the same direction (FIG. 4) so that its lever engaging end 47 moves the rearward end 28 of lever 24 upwardly and thus the forward end 28 of lever 24 downwardly to release latch member 8 from keeper 12. Likewise, when knob 43 is turned in the opposite direction primary lift arm 45 rotates in the opposite direction therewith causing the lever engaging end 50 of secondary lift arm 49 to raise rearward end 28 of lever 24 (FIG. 5) by means of pivot pin 54, and thus correspondingly lowers forward end 27 of lever 24 to release latch member 8 from keeper 12.

Referring now to FIG. 9, there is illustrated a gate ejector mechanism for ensuring that gate 3 is unlocked when latch member 8 is disengaged from keeper 12. Although normally gate 3 has an inherent resiliency such that when latch member 8 is disengaged from keeper 12 gate 3 will collapse slightly resulting in the unlocking operation, under some circumstances gate 3 may need an ejector mechanism to ensure its unlocking. In order to accomplish this, an ejector block 55 is mounted within the interior of support bar 11, and a leaf spring 56 is mounted on channel member 10 for engagement therewith so that when gate 3 is closed and locked spring 56 is compressed. As a result, when lever 24 disengages latch member 8 from keeper 12, leaf spring 56 will force gate 3 away from support bar 11 thus ensuring unlocking of gate 3.

Figure 10:
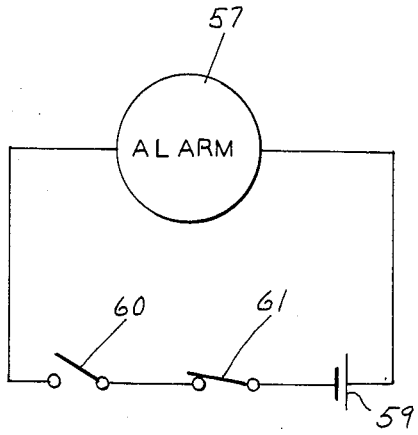

Emergency gate release 1 also includes an alarm 57 in the form of a buzzer mounted on rear wall 14 between support walls 41 and 42. Although alarm 57 is illustrated in the form of an audio buzzer, it is readily apparent that alarm 57 may be any other type of alarm mechanism such as a light or a signal sent to a central control panel. In order to aid in emitting the sound from buzzer 57, bottom wall 15 includes a plurality of openings 58 formed therethrough between support walls 41 and 42. FIG. 10 illustrates the circuit diagram for actuation of buzzer 57. As illustrated, the circuit includes a source of electric current such as a battery 59, and a pair of on-off switches 60, 61 disposed in series with battery 59 and buzzer 57. Thus, upon the closing of switches 60, 61 to their "on" positions buzzer 57 will be actuated. As shown best in FIGS. 2 and 3, battery 59 is mounted within a battery bracket 62 connected to support wall 40.

Figure 6:
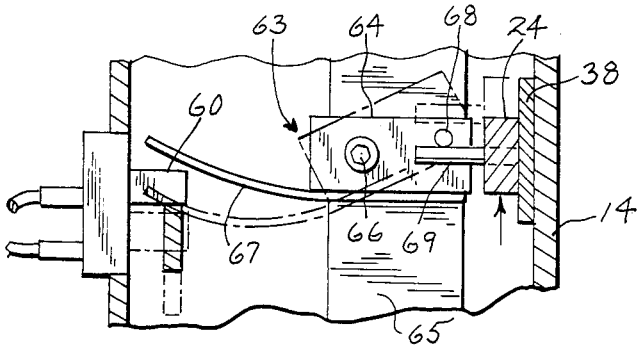
FIG. 6 is a fragmentary cross sectional view taken along the plane of the line 6—6 in FIG. 3 illustrating the actuation of the alarm mechanism.

As shown best in FIGS. 7 and 8, switch 60 is configured so that it is open or "off" when in its raised position and closed or "on" when in its lower position. Switch 61 is configured oppositely from switch 60 so that switch 61 is closed or "on" in its raised position and open or "off" in its lowered position. Thus, assuming the configuration illustrated in FIG. 10 for switches 60, 61, switch 60 is actuated to its closed or on position by means of a switch lever 63 which is responsive to the movement of latch release lever 24 to its latch release position to actuate buzzer 57. In order to accomplish this, switch lever 63 includes a body 64 pivotally mounted on an upstanding post 65 supported by bottom wall 15 (see FIG. 6). The pivotal connection is provided by a pin 66 extending through body 64 into post 65. Switch lever 63 also includes a thin arcuate shaped strip 67 of spring steel connected to the underside of body 64 and projecting therefrom toward switch 60. As illustrated in solid lines in FIG. 6, strip 67 is movable between a first non-contact position disengaged from switch 60 when latch release lever 24 is in its neutral position and a second contact position (in dashed lines in FIG. 6) engaged with switch 60 to move switch 60 to its lowered on position to close switch 60 when latch release lever 24 is moved to its latch release position in order to actuate buzzer 57. This movement from a disengaged position to an engaged position is accomplished by means of the contact between a pin 68 projecting from body 64 of switch lever 63 and another pin 69 projecting from rearward end 28 of lever 24 beneath pin 68. Thus, when latch release lever 24 is moved to its latch release position so that rearward end 28 is moved upwardly, pin 69 engages pin 68 which in turn pivots body 64 and strip 67 in a counterclockwise direction so that strip 67 moves switch 60 downwardly to its closed or on position. Therefore, once switch 60 is closed the circuit of FIG. 10 is complete and buzzer 57 sounds an alarm indicating that the latch member 8 has been disengaged from keeper 12 and gate 3 has been unlocked.

Referring further to FIGS. 7 and 8, there is illustrated a mode selector means for selectively actuating switches 60, 61 and in particular for selectively actuating switch 61 independently of switch 60. As illustrated, the mode selector means includes a cam plate 70 mounted for reciprocal pivotal movement on an upstanding bracket 71 supported from bottom wall 15. The pivotal connection of cam plate 70 is provided by a pin 72 extending through plate 70 and bracket 71, and includes a nylon washer 73 interposed between plate 70 and bracket 71 on pin 72 to provide a bearing surface therefore. Plate 70 includes a first cam arm 74 and a second cam arm 75 projecting from one side thereof. The length of cam arm 74 is dimensioned such that upon counterclockwise rotation of plate 70 (see FIG. 8) cam surface 76 thereof engages only switch 61 to move switch 61 downwardly to its open or off position. In contrast, the length of cam arm 75 is dimensioned to be longer than that of cam arm 74 so that upon clockwise rotation of plate 70 (FIG. 7) cam surface 77 engages both switches 60 and 61 to move switches 60, 61 upwardly so that switch 60 is opened or in its off position and switch 61 is moved upwardly to its on or closed position. Thus, if a user wishes to set the lock release mechanism to its "on" mode the user rotates cam plate 70 clockwise as shown in FIG. 7 so that upon movement of latch release lever 24 to its latch release position switch lever 63 pivots causing strip 67 to move switch 60 to its closed or on position to actuate buzzer 57. On the other hand, if a user wishes to place the lock release mechanism in an "off" mode, the user rotates cam plate 70 counterclockwise in accordance with FIG. 8 so that cam arm 74 moves switch 61 downwardly to its open or off position. As a result, movement of latch release lever 24 to its latch release position and the resulting movement of switch 60 to its closed or on position does not actuate buzzer 57 since switch 61 remains in its open or off position.

In order to accomplish the reciprocal pivotal movement of cam plate 70, there is provided an actuator arm 78 rotatably mounted in a key cylinder 79 which in turn is mounted on an upstanding bracket 80 supported from bottom wall 15. As illustrated best in FIG. 3, a portion of bracket 80 also mounts switches 60, 61 so that switches 60, 61 are aligned with cam arms 74, 75 of cam plate 70. As shown best in FIGS. 7 and 8, actuator arm 78 includes a projecting finger 81 integral therewith and located adjacent cam plate 70. Finger 81 is engageable with a pair of spaced roll pins 82, 83 projecting from the face of cam plate 70 toward bracket 80 so that rotation of actuator arm 78 causes finger 81 to engage roll pin 82 in one direction to pivot cam plate clockwise as in FIG. 7, and engageable with roll pin 83 when rotated in the opposite direction to pivot cam plate 70 in a counter-clockwise direction as illustrated in FIG. 8. Preferably, actuator arm 78 comprises the revolving barrel of a conventional key actuated lock.

A lock release mechanism has been illustrated and described for unlocking a lattice type gate. The lock release mechanism permits unlocking of the gate without a key from one side of the gate but is inaccessible from the other side of the gate. As is readily apparent, various modifications and/or substitutions of the components specifically described herein may be made without departing from the scope of the invention.

Various modes of carrying out the invention are contemplated as being within the scope of the following claims particularly pointing out and distinctly claiming the subject matter regarded as the invention.

I claim:

1. In combination, a lattice gate having opposite sides, lock means on said gate for locking said gate to a static structure, lock release means on one side of said gate for unlocking said gate, and actuator means connected to said lock release means for actuating said lock release means to unlock said gate, said actuator means located on said one side of said gate remote from said lock means and inaccessible from the other side of said gate, said lock means includes a keeper, a latch member pivotable between a locked position engaged with said keeper and an unlocked position disengaged from said keeper, and spring means biasing said latch member to said locked position, and said lock release means includes a latch release lever pivotable between a first neutral position and a second latch release position, said latch release lever having a forward end and a rearward end wherein the forward end of said latch release lever engages said latch member and moves said latch member to said unlocked position.

2. The combination of claim 1 wherein said actuator means includes a rotatable release knob and a primary lift arm having a lever engaging end and an opposite arm engaging end and affixed to said grip member for rotation therewith at a location between said lever engaging end and said arm engaging end.

3. The combination of claim 2 wherein said actuator means further includes a secondary lift arm having a lever engaging end and a mounting end, said mounting end including a pivot connection for said secondary lift arm, and a pivot pin interconnecting the arm engaging end of said primary lift arm and said secondary lift arm at a location between the lever engaging end and the mounting end of said secondary lift arm whereby rotation of said grip member in one direction rotates the primary lift arm in one direction so that its lever engaging end moves said latch release lever and rotation of said grip member in the opposite direction rotates the primary lift arm in the opposite direction to pivot said secondary lift arm so that its lever engaging end moves said latch release lever 4. The combination of claim 3 further including spring means for biasing said latch release lever to its first neutral position.

5. The combination of claim 4 further including adjusting means for adjusting the position of the forward end of said latch release lever.

6. The combination of claim 5 wherein said adjusting means includes means for vertically adjusting the pivot connection of said latch release lever.

7. The combination of claim 1 further including alarm means and alarm actuating means responsive to the movement of said latch release lever to its latch release position for actuating said alarm means.

8. The combination of claim 7 wherein said alarm actuating means includes circuit means having a source of electric current, switch means disposed in series with said current source and said alarm means, and a switch lever pivotally mounted between a first non-contact position disengaged from said switch means when said latch release lever is in its neutral position and a second contact position engaged with said switch means to close said switch means when said latch release lever is moved to its latch release position whereby said alarm means is actuated.

9. The combination of claim 8 wherein said switch means includes a pair of on-off switches disposed in series with said current source and alarm means, and said switch lever engages only one of said on-off switches, and further including mode selector means for selectively actuating the other of said on-off switches independently of said one on-off switch.

10. The combination of claim 9 wherein said mode selector means includes cam means movable between a first position which moves said other on-off switch to its off position and a second position which simultaneously moves said one on-off switch to its off position and said other on-off switch to its on position whereby pivotal movement of said switch lever to its second contact position moves said one on-off switch to its on position to actuate said alarm means.

11. The combination of claim 10 wherein said cam means comprises a cam plate mounted for reciprocal pivotal movement, said cam plate includes a first cam arm engageable only with said other on-off switch and a second cam arm engageable with both of said on-off switches.

12. The combination of claim 1 further including gate ejector means for biasing said gate to an unlocked position.

13. The combination of claim 12 wherein said gate ejector means comprises a spring compressed when said gate is locked.

* * * * *